United States Patent [19]

Baltzinger

[11] Patent Number: 4,901,653

[45] Date of Patent: Feb. 20, 1990

[54] HEARTH FOR A FURNACE, NOTABLY A FURNACE FOR URBAN WASTE, INCLUDING A GRATE MADE UP OF ALTERNATELY FIXED AND RECIPROCATING BARS, WITH INCREASED FLEXIBLITY OF ADJUSTMENT

[75] Inventor: Daniel Baltzinger, Chevreuse, France

[73] Assignee: T.I.R.U. - Traitement Industriel des Residus Urbains, Paris, France

[21] Appl. No.: 297,868

[22] PCT Filed: Apr. 26, 1988

[86] PCT No.: PCT/FR88/00203

§ 371 Date: Dec. 20, 1988

§ 102(e) Date: Dec. 20, 1988

[87] PCT Pub. No.: WO88/08502

PCT Pub. Date: Nov. 3, 1988

[30] Foreign Application Priority Data

Apr. 27, 1987 [FR] France ..... 87 05912

[51] Int. Cl.[4] ..... F23H 7/08

[52] U.S. Cl. ..... 110/281; 110/291; 110/298; 198/773; 414/156

[58] Field of Search ..... 110/281, 282, 283, 284, 110/291, 298; 198/773, 774; 414/156

[56] References Cited

U.S. PATENT DOCUMENTS

| | | | |
|---|---|---|---|
| 2,250,067 | 7/1941 | Martin . | |
| 3,413,938 | 12/1968 | Dvirka | 110/281 X |
| 4,320,710 | 3/1982 | Steiner et al. | 110/281 |

FOREIGN PATENT DOCUMENTS

| | | |
|---|---|---|
| 1240210 | 5/1967 | Fed. Rep. of Germany . |
| 1466632 | 1/1967 | France . |
| 2234523 | 1/1975 | France . |
| 2574160 | 6/1986 | France . |

*Primary Examiner*—Edward G. Favors

*Attorney, Agent, or Firm*—Charles E. Brown; Charles A. Brown

[57] ABSTRACT

The grate comprises, within its length, two consecutive beds (41, 42) with substantially the same general slope joined together at a point in substantial vertical alignment with the altar wall (7), each bed having its own mobile frame (**45*d*, 46*d*) with its own control means (45, 46) and its own draft chamber (43, 44) with its own ventilation means. It is therefore possible to adjust the combustion conditions so as to optimize the carbonization mode combustion on the upstream bed (41) and the brasier mode combustion on the downstream bed (42**).

10 Claims, 3 Drawing Sheets

HEARTH FOR A FURNACE, NOTABLY A FURNACE FOR URBAN WASTE, INCLUDING A GRATE MADE UP OF ALTERNATELY FIXED AND RECIPROCATING BARS, WITH INCREASED FLEXIBLITY OF ADJUSTMENT

The invention relates to a furnace hearth equipped with a grate designed to support a burning mass of solid fragments, notably urban waste, and comprising, sloping downwardly between a loading area at the upstream end and an ash box at the downstream end, at least one bed made up of a succession of transverse bars with a dorsal surface for supporting the mass and a frontal surface with a lower edge sliding of the dorsal surface of the immediately upstream bar, the bars being attached by a downstream end alternately to a fixed frame of the hearth and a mobile frame that can be reciprocated longitudinally by control means, the hearth further comprising, under the grate, at least one draft chamber equipped with ventilation means for feeding combustion-supporting air to the mass through draft holes provided in the bars and, above the grate, a furnace chamber connected to a fumes extractor flue which extends longitudinally from the loading area to a vertical wall referred to as the altar wall, the hearth being extended by a sprung roof from the altar wall to the ash box.

The type of grate fitted to these hearths, in which the surfaces of the elements exposed to the thrust of the burning mass fragments face upstream to oppose rapid descent of the combustible solids and to cause mixing or poking of the mass, has been extensively described in the state of the art since patent U.S. Pat. No. 2,250,067 filed in 1938. Since then improvements have been made, directed notably to the arrangement of draft holes which pass through the bar elements to supply combustion-supporting air to the burning mass from draft chambers situated beneath the grate.

Arrangements have been proposed for improving the poking action by providing at least some of the bar elements with projections where their dorsal and front surfaces meet and for improving the cooling of the bars by the draft of combustion-supporting air.

Patent document FR-A-No. 2 574 160 describes a furnace hearth which comprises bar elements provided with faceted transverse projections at the junction of the front surface and the dorsal surface and on the latter surface, with draft holes provided in a rear facet of the projections so as to face downstream and to direct jets of air from below the grate into the mass of combustible solids in a direction at approximately 15° above the horizontal.

This patent document further describes means for maintaining the adjoining bar elements in alignment.

Problems with adjusting the combustion cycle arise from the use of combustible materials comprising solid fragments of varying quality, such as urban waste, sometimes with relatively high concentrations of incombustible components that will form clinker and ash.

What is more, most solid combustible materials exhibit two combustion modes in succession, the first of which is a carbonization mode in which volatile components which burn are released to produce long flames and a brasier mode, virtually without flames, in which combustion continues on the solid components of the combustible material (the "live coals").

The optimum combustion conditions differ according to the combustion mode. During carbonization the bed of combustible material may be relatively thick and the head loss of the combustion-supporting air through the bed remains moderate, the passages between combustible fragments being of relatively large cross-section and the formation of flames encouraging the draft of combustion-supporting air. In brasier mode however, the ash and clinker produce significant head losses in the combustion-supporting air and it is advantageous if the beds are less thick. Also, heat is transferred from the ignited parts to the remaining combustible parts mostly by radiation and to some degree by convection of fumes, and this transfer is compromized by the presence of the ash and clinker.

If, as is common practise, the combustion conditions are adjusted to achieve a compromise between optimizing the carbonization mode combustion and optimizing the brasier mode combustion, approximating the optimum conditions for the carbonization mode which utilizes a major part of the combustion latent energy, the content of unburnt materials in the clinker is high.

An object of the invention is a hearth of the kind defined hereinabove in which the combustion yield is increased by specific adjustments of the combustion conditions in carbonization mode and in brasier mode.

To this end, the invention proposes a furnace hearth equipped with a grate designed to support a burning mass of solid fragments, notably urban waste, and comprising, sloping downwardly between a loading area at the upstream end and an ash box at the downstream end, at least one bed made up of a succession of transverse bars with a dorsal surface for supporting the mass and a frontal surface with a lower edge sliding on the dorsal surface of the immediately upstream bar, the bars being attached by a downstream end alternately to a fixed frame of the hearth and a mobile frame that can be reciprocated longitudinally by control means, the hearth further comprising, under the grate, at least one draft chamber equipped with ventilation means for feeding combustion-supporting air to the mass through draft holes provided in the bars and, above the grate, a furnace chamber connected to a fumes extractor flue which extends longitudinally from the loading area to a vertical wall referred to as the altar wall, the hearth being extended by a sprung roof from the altar wall to the ash box, characterized in that the grate comprises, within its length, two consecutive beds with substantially the same general slope joined together at a point in substantial vertical alignment with the altar wall, each bed having its own mobile frame with its own control means and its own draft chamber with its own ventilation means.

As each of the two grate beds has its own adjustment means, both with respect to the draft and the conditions under which the combustible mass fragments move forward, the upstream bed may be adjusted to optimize the carbonization mode combustion and the downstream bed may be adjusted to optimize the brasier mode combustion.

Also, the division of the hearth into two parts (furnace chamber and sprung roof) joining at the altar wall has the effect of defining different combustion conditions, the furnace chamber lending itself to the development of long flames whereas the downstream sprung roof forms a furnace dome lending itself to the combustion of the "live coals". The separation of the grate into two beds and the separation of the hearth into two parts with junctions between the two parts on the same vertical line jointly contribute to separate optimization of the two combustion modes.

The grate beds are preferably fitted with bar elements as per FR-A-No. 2 574 160.

The grate is advantageously extended by a board above the ash box adjustable in orientation about a horizontal axis adjacent the end of the grate. The orientation of this board serves to adjust the rate at which ash and clinker is tipped into the ash box and thus to control the thickness of the bed of "live coals" on the downstream bed.

Secondary characteristics and the advantages of the invention will moreover emerge from the following description given by way of example with reference to the appended drawings in which.

Figure 1:
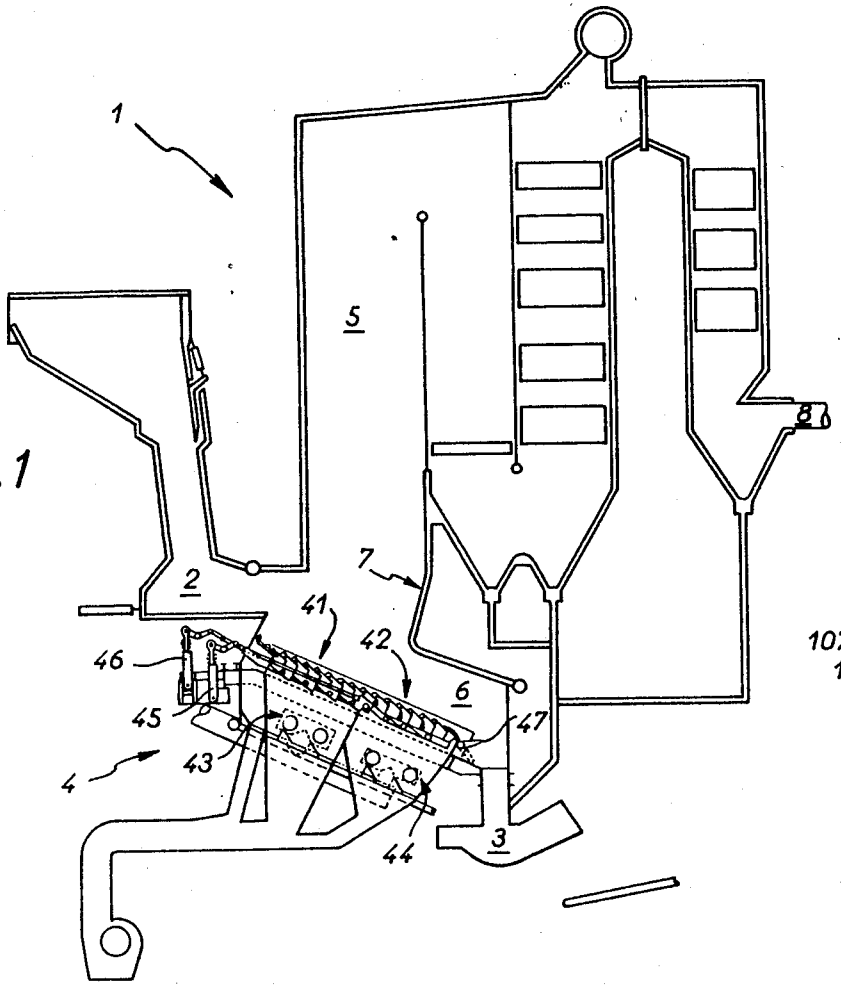
FIG. 1 is a general cross-section through a hearth in accordance with the invention.

In the selected embodiment of the invention shown in FIG. 1 the hearth 1 as a whole comprises, between a loading hopper 2 at the upstream end and an ash box 3 at the downstream end, a grate 4 made up of an upstream bed 41 and a downstream bed 42, the grate beds being made up of bars that are alternately fixed and reciprocatable longitudinally by control means 45 and 46. Beneath the beds 41 and 42 are respective draft chambers 43 and 44. All of this will be described in detail with reference to FIGS. 2 through 4.

Above the bed 41 is a furnace chamber 5 through which the fumes are guided by partitions in a chicane arrangement to an extractor flue 8.

Above the grate 4 the furnace chamber 5 is closed at the downstream end by a brick wall 7 usually referred to as the altar wall. Beyond the altar wall 7 which is substantially vertically aligned with the junction between the grate beds, the hearth is extended longitudinally downstream by a sprung roof 6 which ends at the ash box 3.

Figures 2, 3:
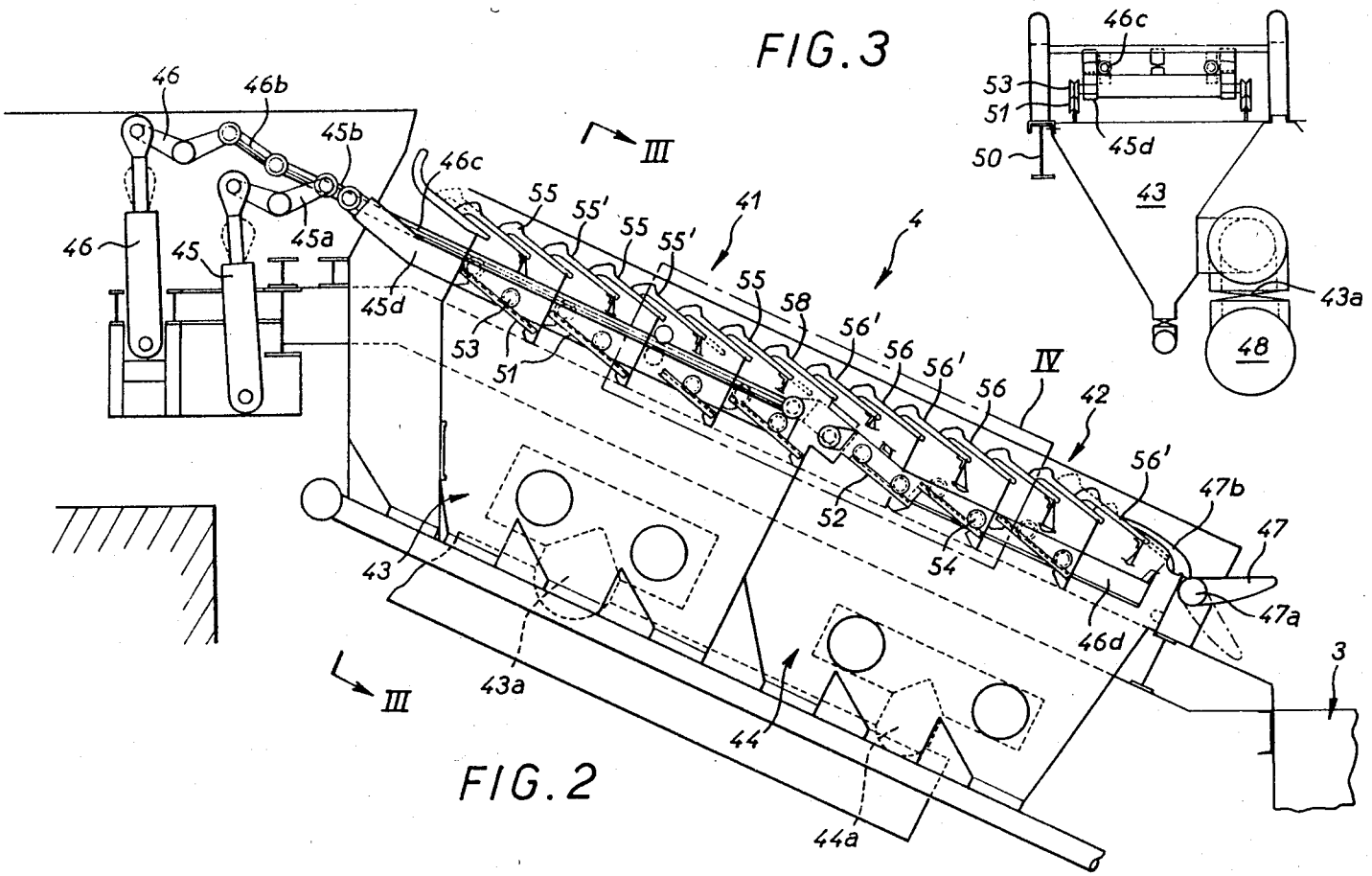
FIG. 2 is a side view of the grate which is fitted to the hearth from FIG. 1.
FIG. 3 is a cross-section on the plane III—III of FIG. 2.
Figure 4:
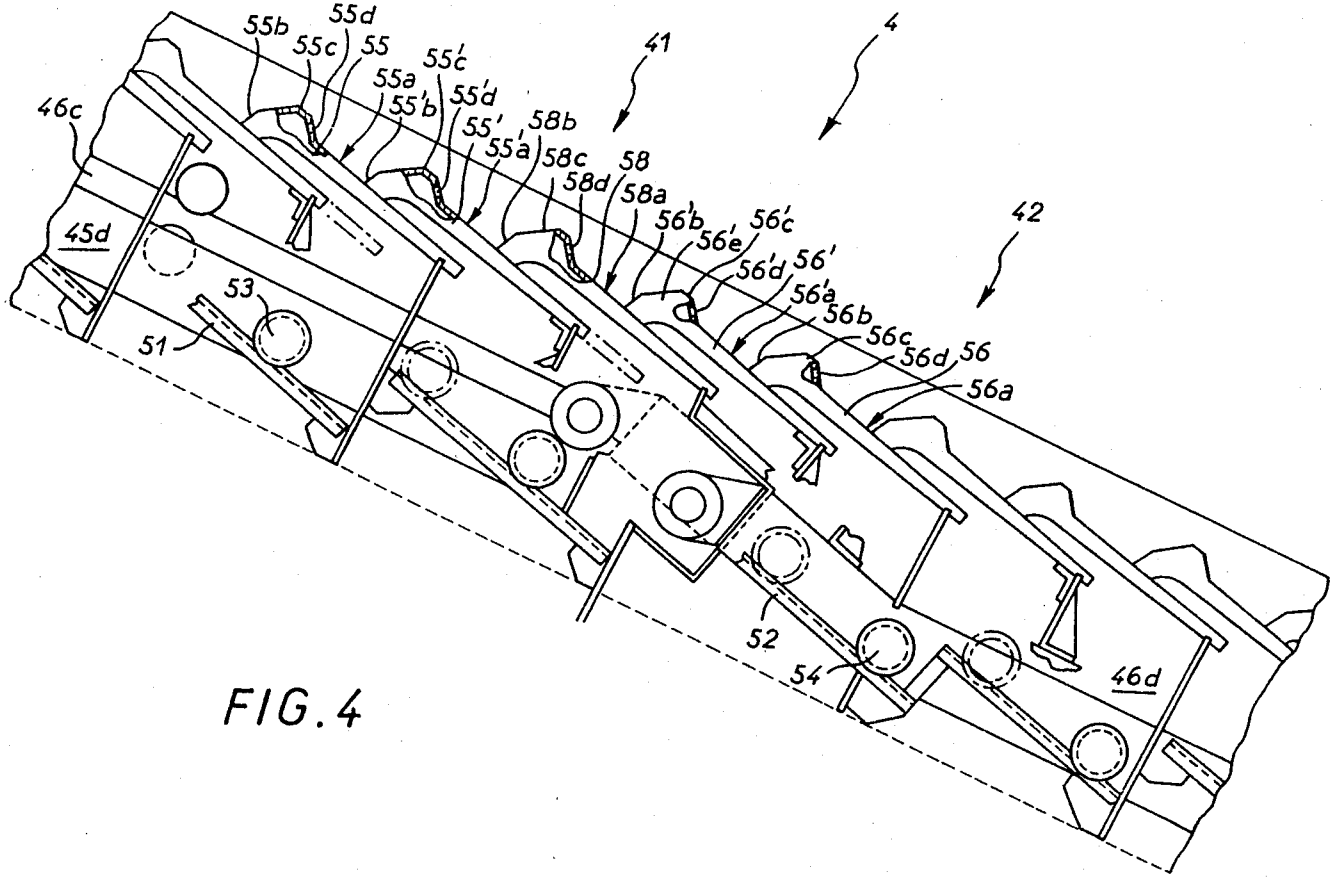
FIG. 4 shows a detail IV from FIG. 2, showing the junction between the two grate beds.

As seen better in FIGS. 2 through 4, the grate 4 is made up of two beds 41 and 42 formed of adjoining bar elements that are alternately fixed (55 and 56) and reciprocatable longitudinally (55' and 56'). The bars comprise (see FIG. 4) dorsal surfaces 55*a*, 55'*a*, 56*a*, 56'*a*, front surfaces facing upstream 55*b*, 55'*b*, 56*b*, and 56'*b* projections 55*c*, 55'*c*, 56*c*, 56'*c* on the dorsal surface 55*a*, 55'*a*, 56*a*, 56'*a* where the latter joins to the corresponding front surface 55*b*, 55'*b*, 56*b*, 56'*b*.

Each bar 55, 55', 56, 56' rests with a lower edge of its front surface 55*b*, 55'*b*, 56*b*, 56'*b* sliding on the dorsal surface of the immediately upstream bar. Also, the fixed bars 55, 56 have their rear ends attached to a crossmember fastened to a hearth frame 50 whereas the mobile bars 55' and 56' have their rear edge attached to respective longitudinally mobile frames 45*d* and 46*d*. To this end the frames 45*d* and 46*d* are fitted with rollers 53, 54 adapted to roll on rails 51, 52 fixed to the hearth frame 50 and disposed parallel to the bars.

Furthermore, the frame 45*d* is coupled at its upstream end by a link 45*b* to a direction-changing lever 45*a* coupled in turn to a double-acting hydraulic ram 45. In a similar way the frame 46*d* has fixed to its forward end a drawbar 46*c* which passes under the bed 41 and is coupled by a link 46*b* to a direction-changing lever 45*a* coupled in turn to a double-acting hydraulic ram 46.

It will be noted that where the beds 41 and 42 join there is a bar 58 with the lower edge of the front surface 58*b* resting on the dorsal surface of the downstream end mobile bar 55' of the upstream bed 41 whereas the dorsal surface 58*a* of this bar 58 supports the front surface 56'*b* of the upstream end mobile bar 56' of the downstream bed 42. The rear end of the bar 58 is attached to a crossmember fastened to the fixed frame 50.

As seen more clearly in FIG. 4, the projections 55*c*, 55'*c*, 56*c*, 56'*c* and 58*c* of the bars include, in a rearwardly facing facet, draft holes 55*d*, 55'*d*, 56*d*, 56'*d* and 58*d* the axes of which are directed in the downstream direction, with a slope in this direction that is nearer the horizontal than the vertical, in this instance appproximately 15°. This arrangement reduces the quantity of flying ash entrained with the fumes.

Under the beds 41 and 42 are respective draft chambers 43 and 44 which are hopper-shaped and connected to a draft duct 48 through adjuster valves 43*a* and 44*a*. It will be noted that the entry of the draft air into the chambers is shown in a very schematic way in figure 1. The outlets from the valves 43*a* and 44*a* into the chambers 43 and 44 are situated at mid-height in the chambers so that the accumulated fine ash which passes through the beds 41 and 42 does not interfere with the draft.

At the downstream end of the grate 4 is a board 47 rotatable about a horizontal shaft 47*a* adjacent the end of the grate and forming a hood above the ash box 3. A panel 47*b* bridges the gap between the (mobile) downstream end bar of the bed 42 and the board 47.

In operation (FIGS. 1 through 4) the urban waste is pushed out of the hopper 2 onto the upstream end of the grate 4. The ram 45 is reciprocated at a controlled rate and through a controlled amplitude, driving the frame 45*d* through the intermediary of the lever 45*a* and the link 45*b* so that the bars 55' are reciprocated at the same rate as the ram 45 and with a corresponding amplitude relative to the bars 55 between which they lie. The mass tipped out from the hopper 2 is kept fragmented and descends the slope along which the grate extends at a rate determined by the operation of the ram 45 and with a thickness dependent on this rate and on the rate at which waste is tipped out from the hopper 2. The flowrate of the draft air is adjusted by the valve 43*a* to secure appropriate combustion with large flames (combustion of the distilled products and carbonization of the fixed parts).

On reaching the bar 58 the waste, for the most part reduced to the solid constituents, essentially heavy tars and carbon and ash vitrified to a greater or lesser degree, passes onto the bed 42 the mobile bars 56' of which are reciprocated by the ram 46 via a mechanism corresponding to that of the bed 41, but with the rate and amplitude adjusted independently by control means. It will be understood that in this way the thickness of the combustible layer may be adjusted to suit the brasier mode combustion conditions; the flowrate of the combustion-supporting draft air is adjusted by the valve 44*a* to suit the composition of the combustible layer and the thickness of this layer in relation to the rate of descent. It will be noted that adjustment of the inclination of the board 47 in conjunction with the adjustable reciprocation of the mobile bars 56' of the bed 42 controls the thickness of the combustible layer.

It will be noted that the movement onto the bed 42 in order to establish combustion in brasier mode coincides with the entry of the combustible layer under the sprung roof 6, beyond the altar wall 7. The sprung roof forms a furnace dome and facilitates maintaining the combustion of the "live coals".

All these arrangements contribute to better use of the combustion heat capacity of urban waste, reducing the amount of unburnt materials in the ash and clinker.

The grate bars are obviously not continuous across the width of the hearth, for readily understandable reasons of weight, deformation, installation and replacement. They are made up of substantially rectangular elements assembled together laterally. However, reducing the weight of the unitary parts by dividing the bars into separate elements, although it facilitates handling, has the disadvantage that the elements are more easily raised off their support on the upstream bar should a foreign body enter the space between the bars.

Figure 5:
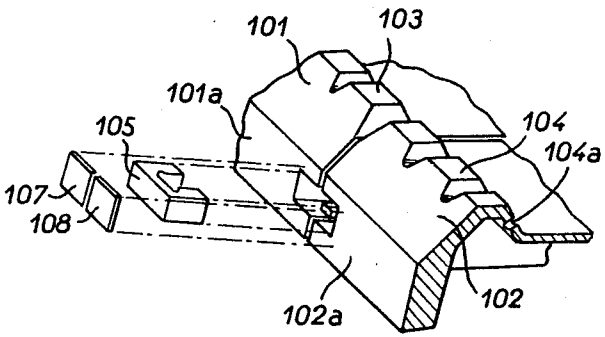
FIG. 5 is a view showing the lateral fixing of the grate bar elements.

As shown in FIG. 5, the elements 101, 102 are fastened through their front surfaces 101*a*, 102*a* below projections 103, 104 in which are formed draft holes 104*a*.

Fastening is achieved by means of a C-shaped clip 105 with two branches joined by a crosspiece, the two branches entering complementary cavities formed in the front surfaces 101*a*, 102*a*. The clip 105 is fully inserted into the front surfaces and is held in place by plates 107, 108 spot arc welded to the front surfaces 101*a*, 102*a*.

The invention is of course not limited to the example described but encompasses all execution variants thereof within the scope of the claims. Thus, for example, the guidance by rollers 53, 54 and rails 51, 52 as described may in some applications be advantageously replaced by guidance of the mobile frames by means of rollers on inclined planes.

What is claimed:

1. Furnace hearth equipped with a grate designed to support a burning mass of solid fragments, notably urban waste, and comprising, sloping downwardly between a loading area (2) at the upstream end and an ash box (3) at the downstream end, at least one bed made up of a succession of transverse bars (55, 55') with a dorsal surface (55*a*, etc) for supporting the mass and a frontal surface (55*b*, etc) with a lower edge sliding on the dorsal surface of the immediately upstream bar, the bars being attached by a downstream end alternately to a fixed frame of the hearth and a mobile frame that can be reciprocated longitudinally by control means, the hearth further comprising, under the grate, at least one draft chamber (43, 44) equipped with ventilation means for feeding combustion-supporting air to the mass through draft holes provided in the bars and, above the grate, a furnace chamber (5) connected to a fumes extractor flue (8) with extends longitudinally from the loading area to a vertical wall (7) referred to as the altar wall, the hearth being extended by a sprung roof from the altar wall to the ash box, characterized in that the grate comprises, within its length, two consecutive beds (41, 42) with substantially the same general slope joined together at a point in substantial vertical alignment with the altar wall (7), each bed having its own mobile frame (45*d*, 46*d*) with its own control means (45, 46) and its own draft chamber (43, 44) with its own ventilation means.

2. Hearth according to claim 1, characterized in that the grate bars (55, 56) are made up of a row of elements (101, 102) substantially rectangular in plan view adjoining at substantially vertical lateral surfaces.

3. Hearth according to claim 2, characterized in that the bar elements (101, 102) comprise at the junction between the front surface and the dorsal surface and above the latter at least one projection (103, 104) trapezium-shaped in longitudinal cross-section with a front facet beginning at the front surface, a rear facet ending at the dorsal surface and an upper facet between the front and rear facets.

4. Hearth according to claim 3, characterized in that the draft holes (104*a*) are formed in the rear facet, substantially normal thereto.

5. Hearth according to claim 4, characterized in that the draft holes have axes upwardly inclined in the downstream direction, nearer the horizontal than the vertical.

6. Hearth according to claim 5, characterized in that the upward slope of the axes of the holes is at an angle of approximately 15° to the horizontal.

7. Hearth according to claim 2, characterized in that said bar elements are fastened together in rows by their front surfaces.

8. Hearth according to claim 1, characterized in that the two beds (41, 42) join together on a bar (58) attached to the fixed frame of the hearth, with the lower edge of its front surface resting on the dorsal surface of the downstream end bar of the upstream bed and its dorsal surface supporting the lower edge of the front surface of the upstream end bar of the downstream bed.

9. Hearth according to claim 1, characterized in that the control means (45, 46) respectively forming part of the two beds (41, 42) are adapted to reciprocate the corresponding frame with an amplitude and at a rate adjustable independently of each other and in that the ventilation means equipping the respective draft chambers of the beds are separately adjustable in terms of flowrate.

10. Hearth according to claim 1, characterized in that the grate is extended by a board (47) above the ash box (3) adjustable in orientation about a horizontal axis adjacent the downstream end of the grate.

* * * * *